United States Patent [19]

Breslow et al.

[11] 4,034,502

[45] July 12, 1977

[54] WHEELED TOY

[75] Inventors: Jeffrey D. Breslow, Highland Park; Eugene Jaworski, Park Ridge, both of Ill.

[73] Assignee: Marvin Glass & Associates, Chicago, Ill.

[21] Appl. No.: 720,748

[22] Filed: Sept. 7, 1976

[51] Int. Cl.[2] ..... A63H 29/00

[52] U.S. Cl. ..... 46/202; 46/204; 46/205

[58] Field of Search ..... 46/97, 201, 202, 204, 46/262

[56] References Cited

U.S. PATENT DOCUMENTS

| | | | |
|---|---|---|---|
| 2,770,074 | 11/1956 | Jones et al. | 46/262 |
| 3,187,461 | 6/1965 | Vicini | 46/205 |
| 3,240,201 | 3/1966 | Shelton | 46/205 |
| 3,512,300 | 5/1970 | Thoresen | 46/202 |
| 3,523,385 | 8/1970 | Noble | 46/205 |

*Primary Examiner*—Louis G. Mancene

*Assistant Examiner*—Robert F. Cutting

*Attorney, Agent, or Firm*—Mason, Kolehmainen, Rathburn & Wyss

[57] ABSTRACT

A wheeled toy which includes a frame portion in the form of a crown for grasping by a user and for manual manipulation of the toy over a support surface. A pair of drive wheels are journalled on the underside of the frame portion for rollingly supporting the frame portion for movement over a support surface in a generally straight line, with front and rear stabilizing wheels. An impeller is rotatably mounted on the crown-shaped frame structure and protrudes outwardly therefrom at the lower marginal periphery thereof in proximity to the support surface for engaging objects on the support surface as the toy is rolled thereover and propelling the objects away from the toy. The drive wheels are operatively connected to the impeller and protrude downwardly therefrom for rotating the impeller in response to rotation of the wheel means as the toy is rolled over the support surface.

16 Claims, 4 Drawing Figures

Fig 1
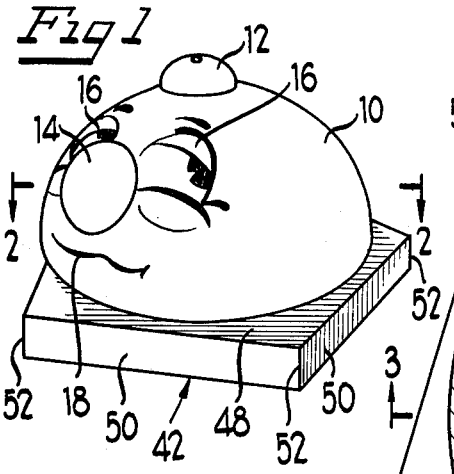
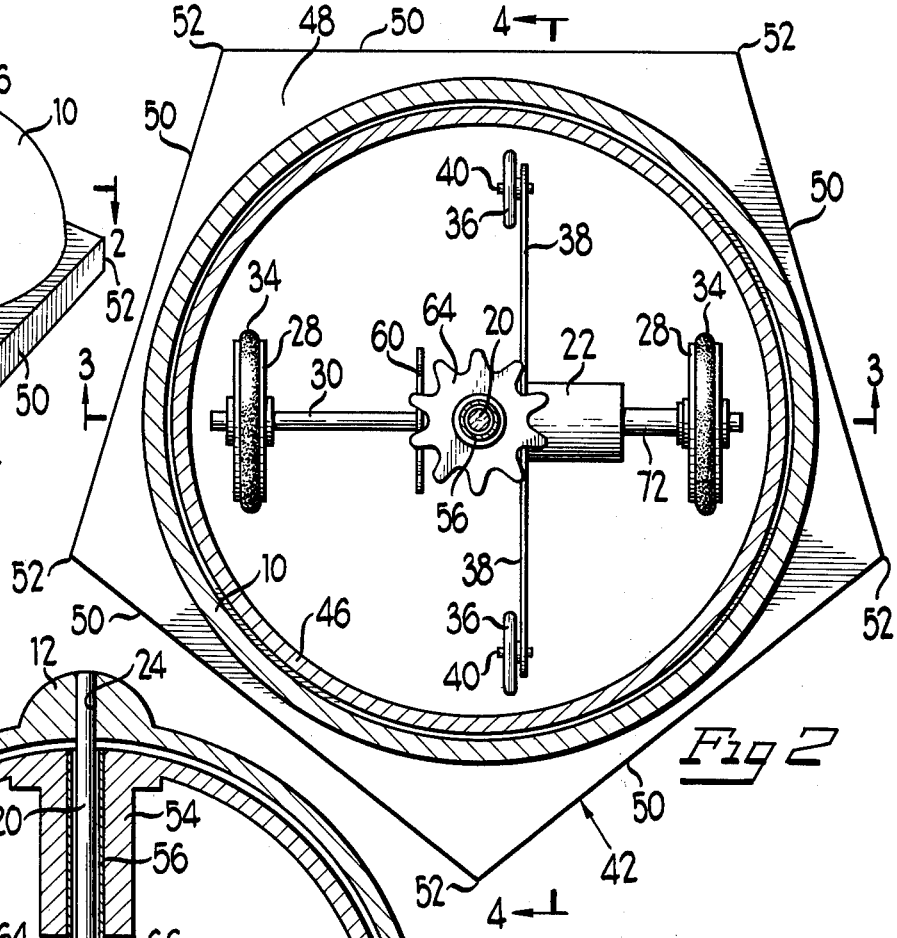
Fig 2
Fig 3
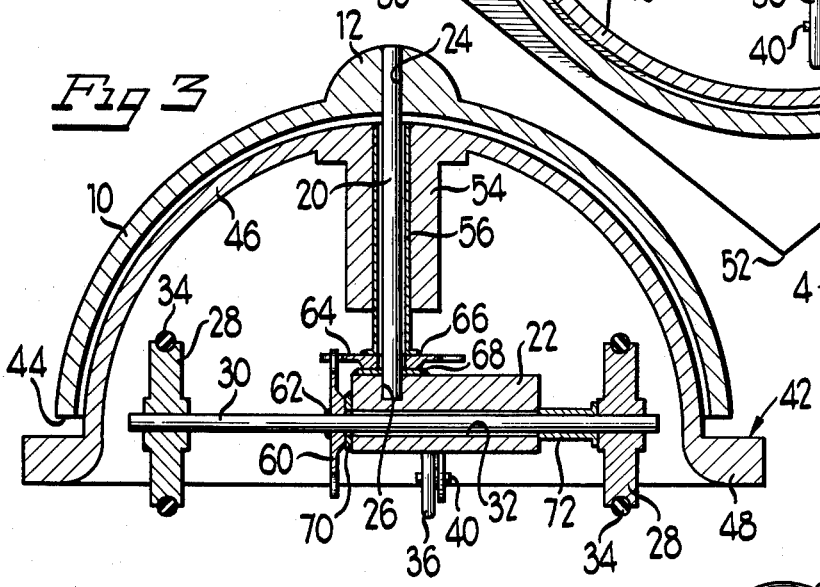
Fig 4
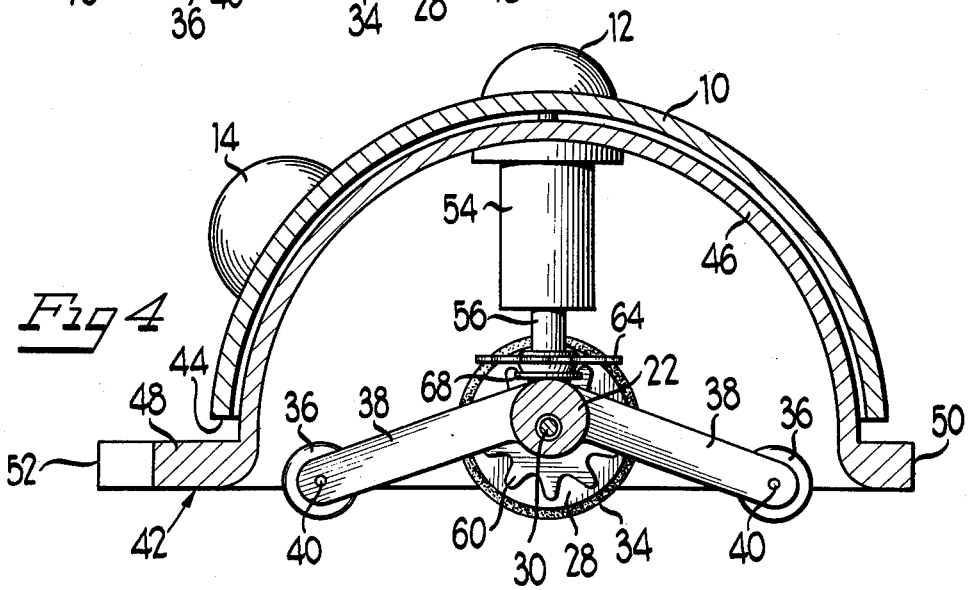

WHEELED TOY

BACKGROUND AND SUMMARY OF THE INVENTION

This invention is directed to a wheeled toy and, particularly, to a wheeled toy which is manually manipulated by children for movement over a supporting surface, such as a floor, or the like, to engage objects on the support surface and propel the objects in various directions away from the toy during movement.

Toy vehicles have been a source of enjoyment for children for many years. Most toy vehicles, particularly wheeled vehicles, are designed for manual manipulation over a support surface, such as a floor, or the like, to simulate actual operation of the vehicle. In some instances, the toy is designed to be played with in conjunction with extraneous objects or materials, such as construction vehicles for moving or lifting sand or other objects during play. The present invention is directed to a wheeled toy which has an upper frame portion for manual grasping by a user to move the toy over a support surface and the toy has a lower impeller member in proximity to the support surface for striking objects thereon and propelling the objects outwardly in various directions away from the toy as it is moved over the support surface.

More particularly, in the exemplary embodiment of the invention, the wheeled toy includes a rounded inverted cup-shaped frame portion forming an upper crown of the toy for grasping by the user. The crown or frame portion has wheel means journalled on the underside thereof for rollingly supporting the frame portion for movement over the support surface generally in a straight line of travel. A polygonal shaped impeller member is mounted on the toy and protrudes outwardly from the lower marginal periphery of the crown in proximity to the support surface for engaging objects in the support surface as the toy is rolled thereover and the apexes of the polygonal shaped impeller propel the objects away from the toy. The wheel means includes a pair of side drive wheels operatively connected to the impeller for rotating the impeller about a generally vertical axis in response to rotation of the wheel means as the toy is rolled over the support surface. Front and rear wheels also are provided to facilitate the straight movement of the toy. A rod is fixed to the underside of the crown-shaped frame portion and protrudes downwardly thereof and terminates in a bearing block for journalling the drive wheels thereon, with the drive wheels extending below the impeller for engaging the support surface. The impeller itself is journalled on the rod beneath the crown-shaped frame portion and is connected through gearing to an axle for the drive wheels for conjoint rotation therewith.

Other objects, features and advantages of the invention will be apparent from the following detailed description taken in conjunction with the accompanying drawings.

BRIEF DESCRIPTION OF THE DRAWINGS

FIG. 1 is a perspective view of the toy of the present invention;

FIG. 2 is a horizontal section, on an enlarged scale, taken generally along line 2—2 of FIG. 1;

FIG. 3 is a vertical section taken generally along line 3—3 of FIG. 2; and

FIG. 4 is a vertical section taken generally along line 4—4 of FIG. 3.

DESCRIPTION OF THE PREFERRED EMBODIMENT

The toy of the present invention, as exemplified by FIGS. 1 through 4 herein, includes a rounded inverted cup-shaped crown or frame portion 10 extending over the top of the toy for grasping by a user and for manual manipulation of the toy over a support surface such as a floor, or the like. With the frame portion or crown 10 being of a generally inverted cup-shape, the interior operative and/or drive components (as described hereinafter) are substantially concealed from view when the toy is positioned in its proper erect position on the supporting surface, as shown in FIGS. 1, 3 and 4. The crown 10 as shown in FIGS. 1, 3 and 4 includes exterior rounded protrusions 12 and 14 simulating a small hat and an enlarged nose, respectively, to simulate facial expressions, along with eyes 16 and a mouth 18 on the outer surface of the crown or dome 10. A vertical rod member 20 (FIG. 3) is fixed to the underside of the crown 10 at the upper end of the rod member and extends downwardly and is fixedly secured to a rounded, horizontally extending bearing block 22. The rod member 20 is secured within a bore 24 in the top center of the crown 10 and is fixed with a bore 26 at the top of the bearing block 22. A pair of generally parallel drive wheels 28 are fixed to opposite ends of an axle or shaft 30 which is journalled in a horizontal bore 32 in the bearing block 22 for rotation of the drive wheels 28 and axle 30 relative to the bearing block, rod member 20 and crown 10. The drive wheels 28 have resilient O-rings 34 about the outer periphery thereof for frictional engagement with a supporting surface, such as a floor or the like, for rollingly supporting the toy for movement over the support surface.

A pair of stabilizing wheels 36 are rotatably mounted on the ends of a pair of fore and aft arms 38 which are fixed to the bearing block 22 at the opposite ends thereof. In this manner, the parallel side drive wheels 28 and the fore and aft stabilizing wheels 36 facilitate rolling the toy over the support surface in a generally straight line, preferably with the facial features 14-18 on the outside of the frame portion or crown 10 facing in the direction of movement of the toy. The stabilizing wheels are mounted on stub shafts 40 for rotation relative to the arms 38.

An impeller member, generally designated 42, is mounted on the underside of the crown 10 for rotation about the vertical rod member 20 and protrudes outwardly from the lower marginal peripheral edge 44 of the crown. More particularly, the impeller member 42 includes a dome-shaped portion 46 directly beneath the dome-shaped crown 10 and has a horizontally protruding flange portion 48 extending outwardly from the dome-shaped portion 46 beyond the extremities of the crown 10 in proximity to the support surface for engaging objects on the support surface as the toy is rolled thereover and propelling the objects away from the toy. The flange portion 48 of the impeller 42 can take various configurations so as to present protruding striking surfaces for engaging the objects. In the embodiment of the invention shown in the drawings, the flange portion 48 of the impeller 42 is polygonal in horizontal configuration (as best seen in FIGS. 1 and 2) so as to present straight side edges 50 terminating in apexes 52 of the polygonal shape. The dome-shaped portion 46 of the impeller 42 is generally concentric with the outer dome-shaped frame portion or crown 10 and has a downwardly extending central boss 54. The boss 54 is fixedly secured to a vertical elongated drive tube or sleeve 56 which surrounds the vertical rod member 20 on the underside of the crown 10 for rotation relative to the rod member and crown.

Drive means is provided operatively connecting the impeller member 42, through the sleeve 56, to the drive wheels 28 for rotating the impeller about the vertical axis of the rod member 20 in response to rotation of the drive wheels 28 about their horizontal axle 30 as the toy is rolled over the support surface. More particularly, a vertically oriented gear member 60 is fixed to the axle 30, as by welding 62. A horizontal gear member 64 is in mesh with the gear member 60 and is fixed to the lower end of the sleeve 56, as by welding 66. The gear member 64 is loosely mounted about the rod member 20 above the bearing block 22 with a bearing washer 68 between the gear member 64 and the bearing block 22. A second washer 70 is disposed between the gear member 60 on the drive wheel axle 30 and the lefthand end (as viewed in FIG. 3) of the bearing block 22. A spacer bushing 72 is provided between the righthand side of the bearing block 22 (as viewed in FIG. 3) and the righthand drive wheel 28 so as to space both drive wheels 28 generally equidistant from the vertical rod member 20 and thus substantially the vertical axis of rotation of the impeller member 42.

Thus, it can be seen that the drive wheels 28 and the stabilizing wheels 36 facilitate moving the toy in a generally straight direction as the impeller is horizontally rotated during movement for striking objects on the supporting surface, with the vertical axis of rotation of the impeller being generally perpendicular to the horizontal axis of rotation of the drive wheels.

In operation, a user grasps the dome-shaped crown or frame portion 10 and pushes the toy fore and aft over a supporting surface in the direction of the aforesaid wheel means during which the impeller 42 rotates in a generally horizontal plane to strike and propel objects on the supporting surface in various directions away from the toy, depending upon the speed of movement of the toy and the configuration of the outwardly protruding flange portion 48 of the impeller 42 (herein, a polygonal configuration).

The foregoing detailed description has been given for clearness of understanding only and no unnecessary limitations should be understood therefrom as some modifications will be obvious to those skilled in the art.

We claim:

1. A wheeled toy, comprising: a frame portion for grasping by a user and for manual manipulation of the toy, wheel means journalled on said frame portion for rollingly supporting the frame portion for movement over a support surface, an impeller rotatably mounted on said frame portion and protruding outwardly therefrom in proximity to the support surface for engaging objects on the support suface as the toy is rolled thereover and propelling the objects away from the toy, and drive means operatively connecting said impeller and said wheel means for rotating the impeller in response to rotation of the wheel means as the toy is rolled over the support surface.

2. The wheeled toy of claim 1 wherein said frame portion is disposed generally above said impeller and said impeller protrudes outwardly from the lower marginal periphery of the frame portion.

3. The wheeled toy of claim 2 wherein said wheel means is journalled beneath said frame portion and protrudes downwardly therefrom below said impeller for engaging the support surface.

4. The wheeled toy of claim 3 including connecting means between said frame portion and said wheel means and extending through said impeller for journalling said wheel means.

5. The wheeled toy of claim 4 wherein said impeller is journalled by means for rotation about said connecting means.

6. The wheeled toy of claim 5 wherein said connecting means includes a rod member extending downwardly from said frame portion through said impeller and a bearing block connected to the bottom of said rod member for journalling said wheel means, said impeller being mounted for rotation about said rod member.

7. The wheeled toy of claim 6 wherein said rod member extends generally vertically when said toy is rollingly supported on the support surface and said wheel means is journalled for rotation about a generally horizontal axis perpendicular to said rod member.

8. The wheeled toy of claim 1 wherein said wheel means is journalled for rotation about a generally horizontal axis when rollingly supported on the support surface and said impeller is mounted for rotation about a generally vertical axis perpendicular to the axis of rotation of said wheel means.

9. The wheeled toy of claim 1 wherein said wheel means comprises a pair of generally parallel drive wheels journalled for rotation about a common side-to-side axis for movement of the frame portion in a direction generally perpendicular to said drive axis, and at least one stabilizing wheel rotatably mounted to the frame portion engageable with the support surface and spaced from the axis of rotation of said drive wheels.

10. The wheeled toy of claim 1 wherein the periphery of said impeller is polygonal in shape with apexes thereof extending outwardly of said frame portion for engaging and striking objects on the support surface as the impeller is rotated by said wheel means.

11. The wheeled toy of claim 1 wherein said frame portion is in the form of a cup-shaped rounded crown disposed generally above the impeller with the impeller protruding outwardly from the lower marginal periphery of the cup-shaped frame crown.

12. The wheeled toy of claim 11 wherein the periphery of said impeller is polygonal in shape with apexes thereof extending outwardly of said frame portion for engaging and striking objects on the support surface as the impeller is rotated by said wheel means.

13. A wheeled toy, comprising: a frame portion in the form of a rounded inverted cup-shaped crown for grasping by a user and for manual manipulation of the toy, an impeller disposed beneath said crown-shaped frame portion, wheel means journalled on the underside of said frame portion and extending downwardly of said impeller for rollingly supporting the frame portion for movement over a support surface, connecting means extending downwardly from the underside of said frame portion through said impeller including journal means for said wheel means, means rotatably mounting said impeller to said connecting means and protruding outwardly from said frame portion in proximity to the support surface for engaging objects on the support surface as the toy is rolled thereover and propelling the objects away from the toy, and drive means operatively connecting said impeller and said wheel means for rotating the impeller in response to rotation of the wheel means as the toy is rolled over the support surface.

14. The wheeled toy of claim 13 wherein said wheel means is journalled on said connecting means for rotation about a generally horizontal axis when the toy is supported on the support surface, and the impeller is rotatably mounted on said connecting means for rotation about a generally vertical axis generally perpendicular to the axis of rotation of said wheel means.

15. The wheeled toy of claim 13 wherein said wheel means comprises a pair of generally parallel drive wheels journalled for rotation about a common side-to-side axis for movement of the frame portion in a direction generally perpendicular to said drive axis and at least one stabilizing wheel rotatably mounted to the frame portion engageable with the support surface and spaced from the axis of rotation of said drive wheels.

16. The wheeled toy of claim 13 wherein the periphery of said impeller is polygonal in shape with apexes thereof extending outwardly of said frame portion for engaging and striking objects on the support surface as the impeller is rotated by said wheel means.

* * * * *